US011446926B2

(12) United States Patent
Qian et al.

(10) Patent No.: US 11,446,926 B2
(45) Date of Patent: Sep. 20, 2022

(54) SPIT ENERGY LEVELS

(71) Applicant: Hewlett-Packard Development Company, L.P., Spring, TX (US)

(72) Inventors: Li Qian, Sant Cugat del Valles (ES); Jamie Juan Munoz, Sant Cugat del Valles (ES); David Munoz Navarro, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/261,052

(22) PCT Filed: Dec. 3, 2018

(86) PCT No.: PCT/US2018/063644
§ 371 (c)(1),
(2) Date: Jan. 18, 2021

(87) PCT Pub. No.: WO2020/117199
PCT Pub. Date: Jun. 11, 2020

(65) Prior Publication Data

US 2021/0291518 A1 Sep. 23, 2021

(51) Int. Cl.
*B41J 2/045* (2006.01)

(52) U.S. Cl.
CPC ..... *B41J 2/04598* (2013.01); *B41J 2/04541* (2013.01); *B41J 2/04573* (2013.01); *B41J 2/04586* (2013.01)

(58) Field of Classification Search
CPC ..... B41J 2/04598; B41J 2/04541; B41J 2/04573; B41J 2/04586
See application file for complete search history.

(56) References Cited

U.S. PATENT DOCUMENTS

| | | | | |
|---|---|---|---|---|
| 5,581,281 | A | 12/1996 | Fuse et al. | |
| 5,726,690 | A | 3/1998 | Bohorquez et al. | |
| 6,174,038 | B1 * | 1/2001 | Nakazawa | B41J 2/04581 347/10 |
| 6,481,823 | B1 | 11/2002 | Bauer et al. | |
| 6,908,167 | B2 | 6/2005 | Kitami et al. | |
| 7,976,115 | B2 | 7/2011 | Gibson et al. | |
| 8,622,508 | B2 | 1/2014 | North et al. | |
| 9,289,982 | B2 | 3/2016 | Taff et al. | |
| 9,718,269 | B2 | 8/2017 | Duffield | |
| 9,844,935 | B2 | 12/2017 | Toussaint | |

(Continued)

FOREIGN PATENT DOCUMENTS

WO WO-2008043121 A1 4/2008

*Primary Examiner* — Thinh H Nguyen

(74) *Attorney, Agent, or Firm* — HP Inc. Patent Department

(57) ABSTRACT

A printing apparatus is disclosed. The printing apparatus comprises a printhead and a controller. The printhead is to spit a printing fluid comprising a first mode and a second mode. The first mode corresponds to using a first energy level to spit the printing fluid and the second mode corresponds to using a second energy level to spit the printing fluid. The second energy level comprises a higher energy level than the first energy level. The controller is to determine a decap risk zone associated with the printing fluid, determine in view of the decap risk zone a decap location, and instruct the printhead to spit using the second mode at the decap location.

20 Claims, 4 Drawing Sheets

(56) References Cited

U.S. PATENT DOCUMENTS

| | | | |
|---|---|---|---|
| 2002/0036781 | A1 | 3/2002 | Hirayama et al. |
| 2003/0179255 | A1 | 9/2003 | Mizutani et al. |
| 2008/0084454 | A1 | 4/2008 | Sheahan et al. |
| 2008/0316239 | A1 | 12/2008 | Sheahan et al. |
| 2011/0310149 | A1 | 12/2011 | North |

* cited by examiner

SPIT ENERGY LEVELS

BACKGROUND

Inkjet printers are systems that generate a printed image by propelling printing liquid through nozzles onto printing media locations associated with virtual pixels. The printing liquid drops may comprise pigments or dyes disposed in a liquid vehicle. In some examples, the printing fluid may be stored in a printing fluid repository. The accuracy of the selection of a dye concentration, and/or a pigment concentration may influence the control of the printing liquid propelling onto the substrate. Additionally, or alternatively, the accuracy in which the printing fluid drops are placed in the printing media locations may lead to a better print job quality or image quality (IQ).

BRIEF DESCRIPTION OF THE DRAWINGS

The present application may be more fully appreciated in connection with the following detailed description taken in conjunction with the accompanying drawings, in which like reference characters refer to like parts throughout and in which.

DETAILED DESCRIPTION

Figure 1:
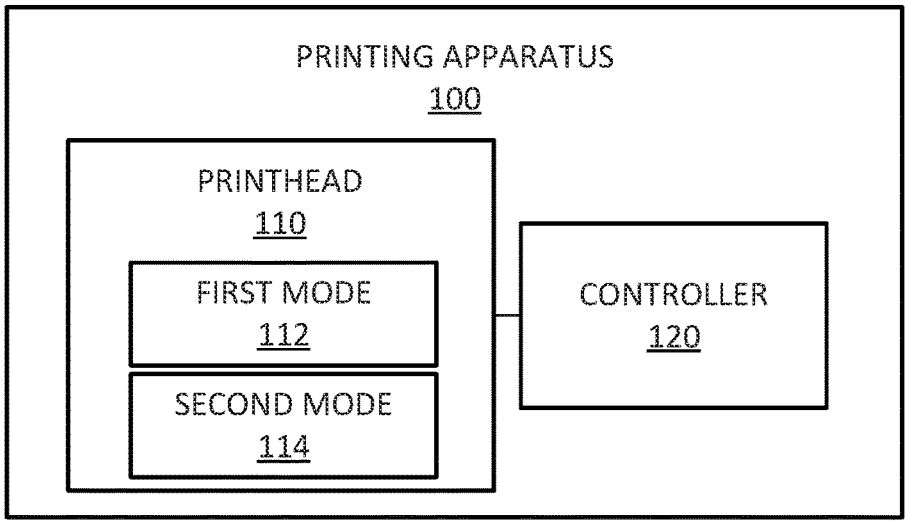
FIG. 1 is a block diagram illustrating an example of a printing apparatus to determine spit energy levels.

The following description is directed to various examples of the disclosure. In the foregoing description, numerous details are set forth to provide an understanding of the examples disclosed herein. However, it may be understood by those skilled in the art that the examples may be practiced without these details. While a limited number of examples have been disclosed, those skilled in the art may appreciate numerous modifications and variations therefrom. It is intended that the appended claims cover such modifications and variations as fall within the scope of the examples. Throughout the present disclosure, the terms "a" and "an" are intended to denote at least one of a particular element. In addition, as used herein, the term "includes" means includes but not limited to, the term "including" means including but not limited to. The term "based on" means based at least in part on.

In the present disclosure reference is made to a printing system, printing apparatus, printing device, and/or printer. The terms "printing system", "printing apparatus", "printing device", and/or "printer" should be read in their broad definition, therefore being any image recording system that uses at least one printhead. In an example, the printing apparatus may be a two-dimensional (2D) desk printer. In another example, the printing apparatus may be a 2D large format printer. In another example, the printing apparatus may be a printing press, for example, an offset printing press. In yet another example, the printing apparatus may be a three-dimensional (3D) printer and/or an additive manufacturing system.

Some examples of printers comprise a plurality of nozzles distributed across a single or a plurality of printheads, wherein each nozzle is assigned to a single printing fluid. In the present disclosure, the term "nozzle" should be interpreted as any cylindrical or round spout at the end of a pipe hose, or tube used to control a jet of printing fluid.

During a printing operation, some nozzles may not propel printing fluid for an amount of time and, therefore the printing fluid located in the tip of the nozzle may be exposed to direct contact with ambient air. If a portion of a printing fluid is exposed to direct contact with ambient air, the concentration of the portion of a printing fluid may vary. The concentration of a printing fluid may vary since the direct contact with ambient air may evaporate, at least in part, the liquid carrier of the printing fluid, therefore increasing the concentration of the dye of the printing fluid and/or the concentration of the pigment of the printing fluid with respect with the remaining liquid carrier. In these conditions, the drops of the printing fluid may be hard to control, and additional uncontrolled satellites may occur, leading to a reduction of the IQ of the print job. This issue, may be known as the so-called "decap".

Precisely, the "decap time" is the time in which a nozzle is uncapped, i.e. the time in which the concentration of the printing fluid does not vary due to the contact with ambient air. In an example, a nozzle is unused for an amount of time greater than the decap time, then the nozzle is most likely going to lead to decap issues, therefore experiencing a reduction of the IQ of the print job. In another example, a nozzle is unused for an amount of time shorter than the decap time, then the nozzle is most likely not going to lead to decap issues, therefore not experiencing any reduction of the IQ of the print job. The decap time may vary depending on many parameters that may affect the change of the printing fluid properties due to decap, for example, the printing fluid composition, temperature, humidity, size of the nozzle bore, and the like. The distance travelled by the printhead, the nozzle and printing fluid associated with the decap time is also known as "decap distance". The decap distance is based on the decap time of a printing fluid and the speed that the nozzle travels, i.e. the speed of the printhead comprising the nozzle.

The decap time associated with a printing fluid may vary depending on the composition of the printing fluid. In an example, the decap time associated with a printing fluid comprising a Magenta colorant may be longer than the decap time associated with a printing fluid comprising a Yellow colorant. Servicing spits may be performed throughout the length of a service zone.

The plurality of nozzles may eject a printing fluid. In an example, the printing fluid may comprise a colorant and/or dye with a liquid carrier; e.g., cartridges and/or liquid toners. Some printing fluids may be dye based printing fluids, where dyes may be understood as a coloring solution. Other printing fluids may be pigment based printing fluids, where pigments may be understood as coloring particles in suspension. In another example, the printing fluid may comprise ink particles and an imaging oil liquid carrier; e.g., liquid toner ink commercially known as HP ElectroInk from HP Inc. In another example, the printing fluid is an additive manufacturing fusing agent which may be an ink-type formulation comprising carbon black, such as, for example, the fusing agent formulation commercially known as V1Q60A "HP fusing agent" available from HP Inc. In an additional example such a fusing agent may additionally comprise an infra-red light absorber. In another additional example, such a fusing agent may additionally comprise a visible light absorber. In yet another additional example such fusing agent may additionally comprise a UV light absorber. Examples of inks comprising visible light enhancers are dye-based colored ink and pigment-based colored ink; e.g., inks commercially known as CE039A and CE042A available from HP Inc. In yet another example, the printing fluid may be a suitable additive manufacturing detailing agent; e.g., formulation commercially known as V1Q61A "HP detailing agent" available from HP Inc. A plurality of examples of the printing fluid that may be propelled by a nozzle has been disclosed, however any other chemical printing fluid comprising an agent in a liquid solvent or in a liquid carrier that may evaporate in contact with ambient air may be used without departing from the scope of the present disclosure.

Some printing apparatuses comprise scanning printheads. Scanning printheads are printheads that are to move above and across the width of the media by propelling printing fluid thereon through printing passes or swaths. The term "swath" may be interpreted as the operation in which the scanning printhead moves at least from an edge of the width of the printing medium to the opposite edge of the printing medium. During a swath, a nozzle from the printhead may selectively propel an amount of the printing fluid therethrough.

As mentioned above, each nozzle from a printhead is to propel an amount of printing fluid to perform the printing operation defined by a print job. In some examples, the amount of printing fluid to be propelled, may be in a form of "spits". Prior starting the printing operation, some printing apparatuses may perform a printing configuration, in which some printing parameters are set and may not vary throughout the printing operation of the print job.

One printing parameter may be the energy level in which the amount of printing fluid is propelled from each of the nozzles. Some examples of printing configurations may not involve a high energy level value since it may lead to an expedited printhead degradation. Printhead degradation may involve replacing the printhead in a more regular basis.

The energy level of the spit from a printhead may be applied by different means depending on the printing technology used. Piezoelectric printing technology comprises applying an electric current to a piezo element which expands, and contracts based on the electric current applied. In piezoelectric printing technology, the energy level of the spit from a given nozzles is based on the electric current selection applied to the piezo element. Thermal inkjet printing technology comprises applying an electrical pulse, i.e. fire pulse, to create a vapor bubble to push a printing fluid drop through the spout of the nozzle. In thermal inkjet printing technology, the energy level of the spit from a given nozzle is based on the electrical pulse applied to each nozzle.

Referring now to the drawings, FIG. 1 is a block diagram illustrating an example of a printing apparatus 100 to determine spit energy levels. The printing apparatus 100 comprises a printhead 110 to spit a printing fluid and a controller 120. In some examples, the printhead 110 is to eject a single printing fluid, e.g. magenta printing fluid. In other examples, the printhead 110 is to eject a plurality of printing fluids, e.g. magenta and yellow printing fluids.

In some examples herein, energy may be supplied to the printhead 110 by an energy source (not shown). The supplied energy may comprise a Pulse-Width Modulated (PWM) signal in which a higher energy level may be achieved by the printhead 110 by increasing the signal voltage, current, and/or frequency. A printhead 110 may achieve a higher energy level in which drops of printing fluid are propelled therefrom by increasing the firing frequency from the supplied energy.

The printhead 110 may spit the printing fluid using a first mode 112 or a second mode 114. The first mode 112 comprises spitting the printing fluid using a first energy level. The second mode 114 comprises spitting the printing fluid using a second energy level. The second energy level comprises a higher energy level than the first energy level. In an example the first energy level comprises a PWM fire pulse with a firing frequency in a range defined by about 550 nanoseconds (ns) and about 650 ns. In another example, the first energy level is set as an energy pulse with a firing frequency of about 600 ns. In an example the second energy level comprises an energy pulse from the range defined by about 650 ns and about 750 ns. In yet another example, the second energy level is set as an energy pulse of about 711 ns.

The controller 120 may be any combination of hardware and programming to implement the functionalities described herein. In some examples herein, such combinations of hardware and programming may be implemented in a number of different ways. For example, the programming of modules may be processor-executable instructions stored on at least one non-transitory machine-readable storage medium and the hardware for modules may include at least one processor to execute those instructions. In some examples described herein, multiple modules may be collectively implemented by a combination of hardware and programming, as described above. In other examples, the functionalities of the controller 120 may be, at least partially, implemented in the form of electronic circuitry.

The printing apparatus 100 may receive a print job. The print job comprises printing instructions to reproduce a physical printed product using the printing fluid from the printhead 110. The printhead 110 may selectively spit the printing fluid onto a printing medium. Therefore, the print job comprises data including the location in which droplets of printing fluid from the printhead 110 should be propelled.

A controller may receive the print job to be printed. In an example, the controller may be the controller 120. In another example, the controller may be an additional controller included in the printing apparatus 100. In yet another example, the controller may be an external controller from the printing apparatus 100 included in, for example, an external computing unit or a remote server. For simplicity, the controller will be referenced hereinafter as the controller 120.

The controller 120 may determine a decap risk zone associated with the printing fluid. As mentioned above the decap time may vary depending on the printing fluid to be used. A decap risk zone is the area to be printed that may have a higher probability of decap occurrence. There may be a plurality of ways to determine the decap risk zone based on the print job. The decap risk zone determination may be performed by the controller 120, an additional controller within the printing apparatus 100, or an external controller away from the printing apparatus 100. In an example, the decap risk zone determination may be performed when the printing apparatus 100 is switched off. In another example, the decap risk zone determination may be performed when the printing apparatus 100 is printing another print job. In yet another example, the controller 120 may perform the decap risk zone determination when the printing apparatus 100 is online.

In an example, the controller 120 may receive the print job to be printed. As mentioned above, the print job comprises data including the location in which droplets of printing fluid from the printhead 110 should be propelled. The controller 120 may determine an idle time of the printing fluid based on the print job. The controller 120 may determine the idle time by checking the time between two consecutive spits of the printing fluid based on the location of the two consecutive spits and the speed the printhead 110 is travelling. The controller 120 may also determine the decap risk zone associated with the printing fluid based on at least one of the idle time and the composition of the printing fluid.

The controller 120 may determine a physical decap location in view of the decap risk zone. The physical decap location may be understood as the physical location over to the corresponding digital location of the decap risk zone. The controller 120 may further instruct the printhead 110 to spit an amount, i.e. decap amount, of the printing fluid using the second mode at the decap location. The decap amount is set as at least the sufficient amount to uncap a nozzle based on the printing fluid therein. In some examples, the controller 120 may instruct the printhead 110 to spit the decap amount of the printing fluid using the second mode throughout the entire print job, if the print job comprises at least one decap risk location. In other examples, the controller 120 may instruct the printhead 110 to spit the decap amount of printing fluid using the second mode on a portion of the print job comprising at least the physical decap location.

As it will be explained in further detail below, an amount of printing fluid spitted in a higher energy level, e.g. higher fire pulse, may increase the decap time of the printing fluid as opposed to the standard spitting energy level. As an example, a given printing fluid has a decap time of 2 seconds in the standard energy level, e.g. fire pulse of 600 ns. By increasing the energy level of the spit, e.g. to a fire pulse of 711 ns, the decap time of the printing fluid may increase to 2.4 seconds. The increase of decap time, e.g. 20% increase of decap time, may enable the printing apparatus 100 to perform print jobs with a reduction of IQ defects due to decap issues.

Figure 2A:
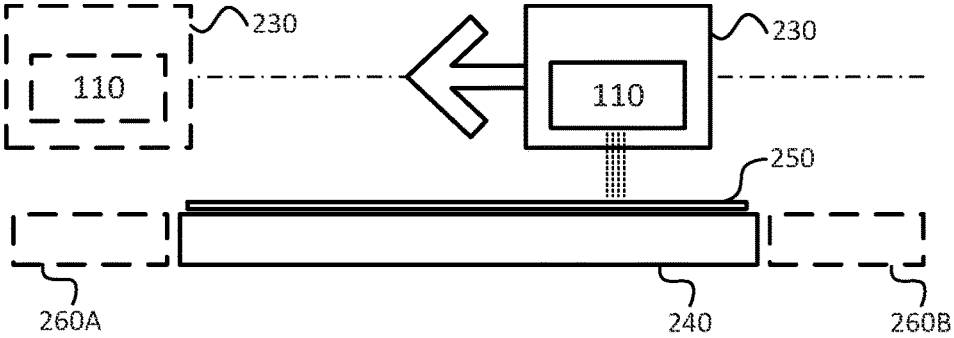
FIG. 2A is a block diagram illustrating an example of a front view of a printing apparatus to determine spit energy levels.
Figure 2B:
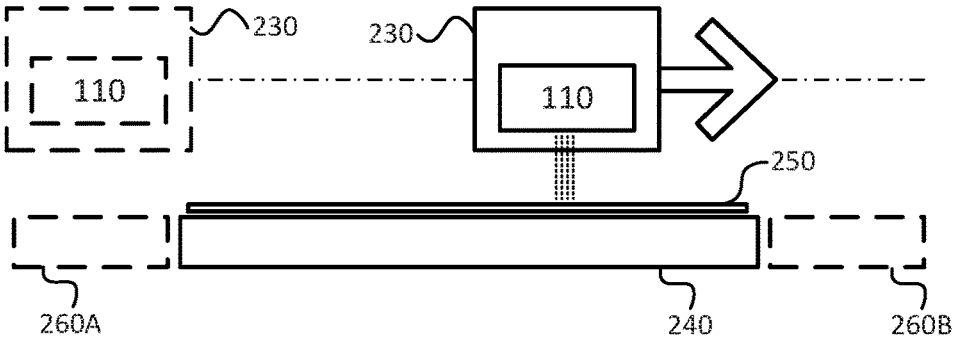
FIG. 2B is a block diagram illustrating another example of a front view of a printing apparatus to determine spit energy levels.

FIGS. 2A and 2B are block diagrams illustrating an example of a front view of a printing apparatus to determine spit energy levels. The printing apparatus comprises a print zone 240. Additionally, the printing apparatus may also comprise a first service zone 260A in a remote location from a first end of the print zone 240 and a second service zone 260B in a remote location from a second end of the print zone 240. In the examples herein, the term "remote" should be interpreted in its broad definition, therefore further including "near" and "adjacent". In an example, the first end and the second end of the print zone 240 may be opposite ends. The printing apparatus may also comprise the controller 120 (not shown for simplicity).

The printing apparatus also comprises a carriage 230. The printhead 110 is mounted in the carriage 230. The carriage 230 may move substantially parallel and over the surface of the print zone 240 along a swath, see e.g., direction defined by the illustrated substantially horizontal dotted lines. In an example, a swath may be defined from a first end of the print zone 240 to a second end of the print zone 240. In another example, the swath may be defined from the furthest end from a first service zone 260A to the furthest end from a second service zone 260B. The term "furthest end" should be understood as about the furthest point of the corresponding service zone with respect to the print zone 240.

The printhead 110 is to spit an amount of printing fluid (illustrated as substantially vertical dotted lines) on the printing medium 250. The printing medium 250 may rest on top of the print zone 240. In some examples, the printing medium 250 may move through the surface of the print zone 240. The amount of printing fluid and the location of the spits on the printing medium 250 may correspond to the print job to be printed. Additionally, the printhead 110 may also move and spit an amount of the printing fluid on the first service zone 260A and/or the second service zone 260B. The controller 120 may instruct the printhead 110 to spit an amount of the printing fluid onto the corresponding location from the print zone 240 based on the print job. The controller 120 may select the energy level of the printing fluid spit on the print zone 240, and the location to spit the amount of printing fluid, based on the determinations according to the examples of FIG. 1.

A wide variety of printing medium 250 to be printed onto may be used. In an example, a paper substrate may be used. Other examples may use different types of substrates, such as a fabric substrate (e.g., textile fabric), a polymeric substrate, and/or additive manufacturing build material. These are examples of printing medium 250; however, other substrates may be used without departing from the scope of the preset disclosure.

FIGS. 2A and 2B illustrate two consecutive swaths of a printing apparatus. Precisely, FIG. 2A illustrates a first swath of the printing apparatus. In FIG. 2A, the controller 120 may instruct the carriage 230 to move (see, illustrated arrow) towards a first end of the print zone 240 or towards the furthest end of the first service zone 260A. The controller 120 may also instruct the printhead 110 to selectively spit an amount of the printing fluid according to the print job. The first swath is considered finished when the carriage 230 reaches the first end of the print zone 240 or the furthest end of the first service zone 260A (carriage 230 in dotted lines). FIG. 2B illustrates a second swath of the printing apparatus. The second swath may start once the carriage 230 is located in the first end of the print zone 240 or the furthest end of the first service zone 260A (carriage 230 in dotted lines). The controller 120 may instruct the carriage 230 to move (see, illustrated arrow) towards a second end of the print zone 240 or towards the furthest end of the second service zone 260B. The controller 120 may also instruct the printhead 110 to selectively spit an amount of the printing fluid according to the print job. In some examples, between the first and the second swath, the printing medium 250 may slide on the print zone 260 and substantially perpendicular to the movement of the carriage 230.

In an example, the controller 120 may determine at least one decap risk zone corresponding to a location from the second swath. The controller 120 may control the printhead 110 to shift from the first mode to the second mode between the first swath and the second swath. Then, once performing the printing operation corresponding to the second swath, the printing fluid may be spit on the printing medium 250 using the second mode, therefore reducing the probability of decap occurrence in the at least one decap risk zone during the second swath. In some examples, the controller 120 may control the printhead 110 to shift from the first mode to the second mode the nozzles corresponding to a printing fluid with the determined decap risk. In other examples, the controller 120 may control the printhead 110 to shift all the nozzles from the first mode to the second mode, irrespective of the printing fluid therein.

In another example, the controller 120 may not determine any decap risk zone corresponding to a location from the second swath. The controller 120 may control the printhead 110 to shift from the second mode to the first mode between the first swath and the second swath. Then, once performing the printing operation corresponding to the second swath, the printing fluid may be spit on the printing medium 250 using the first mode, therefore increasing the lifespan of the printhead 110; i.e. reducing the degradation of the printhead 110 as opposed to printing in using the second mode.

In some examples herein, the controller 120 may identify the printing medium 250 in which the printing fluid is to be spit thereto. The controller 120 may also determine the second mode energy level based on the identified printing medium 250. Additionally, or alternatively, the controller 120 may determine the second mode energy level based on the composition of the printing fluid. As an example, the controller 120 may select the second energy mode by checking a look up table. In an example, the controller 120 may input the printing medium 250 reference along with the printing fluid reference to the look up table, and the look up table may return the second energy level to be used in the second energy mode. As an example, the look up table may be previously imputed to the controller. As another example, a used may encode the look up table in a memory unit within the printing apparatus. In yet another example, the controller 120 may access to an external computing unit, e.g. server, comprising the look up table.

Figure 3:
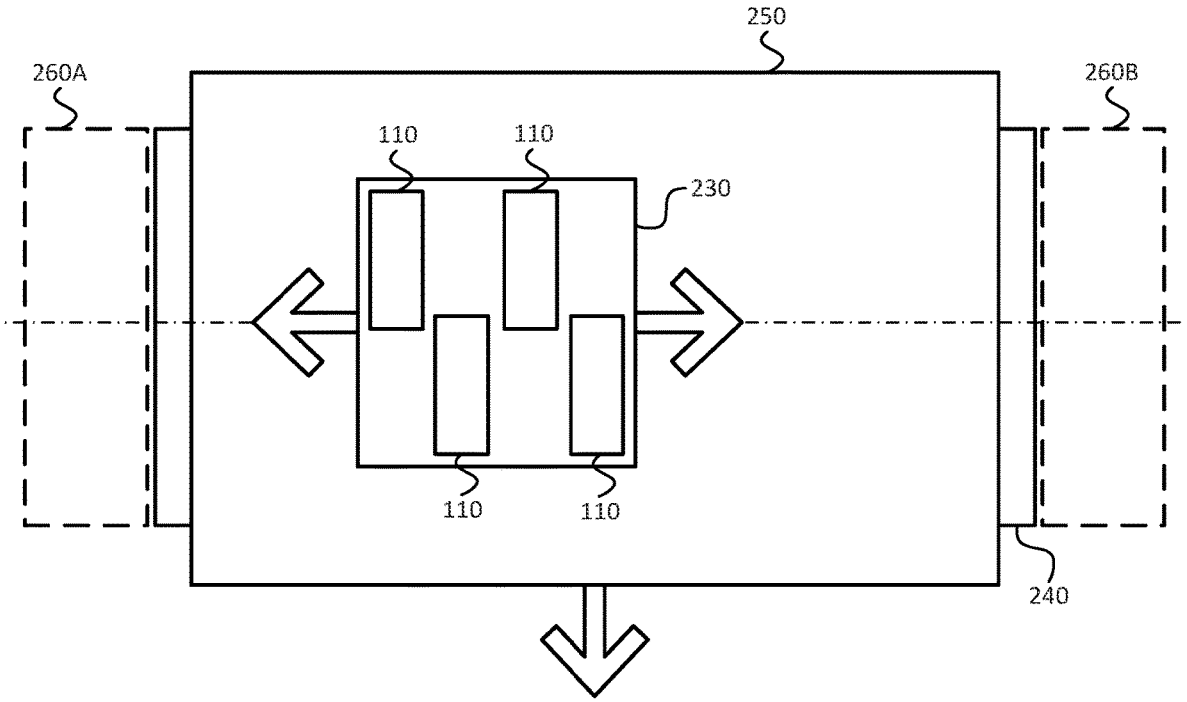
FIG. 3 is a block diagram illustrating an example of a top view of a printing apparatus to determine spit energy levels.

FIG. 3 is a block diagram illustrating an example of a top view of a printing apparatus to determine spit energy levels. The printing apparatus comprises the print zone 240 and the carriage 230. In some examples, the printing apparatus may also comprise the first service zone 260A and/or the second service zone 260B. The printing apparatus comprises the printing medium 250 that moves along the illustrated vertical arrow between two consecutive swaths.

In an example, the printing apparatus is a Large Format Printer and the carriage 230 comprises a plurality of printheads. In the illustrated example, the carriage 230 comprises four printheads 110, however the carriage 230 may comprise more or less printheads without departing from the scope of the present disclosure.

The controller 120 (not shown for simplicity) may control each of the printheads 110 to selectively spit an amount of a printing fluid. A single printhead 110 may be to spit an amount of one or more printing fluid. Some printheads 110 may be placed in different relative locations with each other within the carriage 230, therefore enabling the carriage 230 to encompass a broader area of printing in each swath as opposed to the area defined by the length of a printhead 110. In some examples, the controller 120 may split the nozzles in a printhead into a plurality of nozzle subsets. In an example, the controller 120 may split the nozzles in a printhead into two subsets. In another example, the controller 120 may split the nozzles in a printhead into three subsets. In some examples, the printing area encompassed by each of the subsets is substantially the same.

The controller 120 (or any other controlling entity) may control a printing medium 250 advancement mechanism (not shown) so that, between two consecutive swaths, the printing medium 250 advances a distance corresponding to the length of a subset of nozzles. The printing medium 250 advancement mechanism may be any mechanism comprising the means to control the advancement of the printing medium 250 along the illustrated vertical arrow, e.g. rollers. In an example, the controller 120 may split each printhead into two subsets, therefore the printing medium 250 mechanism may cause the printing medium 250 to advance a distance corresponding to half of a printhead 110 between two consecutive swaths. In another example, the controller 120 may split each printhead 110 into three subsets, therefore the printing medium 250 mechanism may cause the printing medium 250 to advance a distance corresponding to a third of a printhead between two consecutive swaths.

The more subsets a printhead is split into, the more swaths a printing media 250 location may be spit onto. The amount of different swaths a printing media 250 location can be spit onto is also known as the number of passes. The number of passes may also be based on the number of printheads 110 in the carriage 230 and the relative location of the number of printheads 110 with each other. The higher number of printing passes a print job is to be printed, the more completion time the print job will have and the higher IQ the print job will have. In an example following the illustrated printheads 110 configuration, if the controller 120 splits the printheads 110 into two substantially equal groups, the printing apparatus may be printing in a four-pass basis. In another example following the illustrated printheads 110 configuration, if the controller 120 splits the printheads 110 into three substantially equal groups, the printing apparatus may be printing in a six-pass basis.

As mentioned above the controller 130 is to determine a decap risk zone. In an example, the controller 120 is to control the printhead 110 to spit the printing fluid in the second mode during the printing passes that comprise at least one decap risk zone. Additionally, or alternatively, the controller 120 is to control the printhead 110 to spit the printing fluid in the first mode during the printing passes that do not comprise a decap risk zone.

Figure 4:
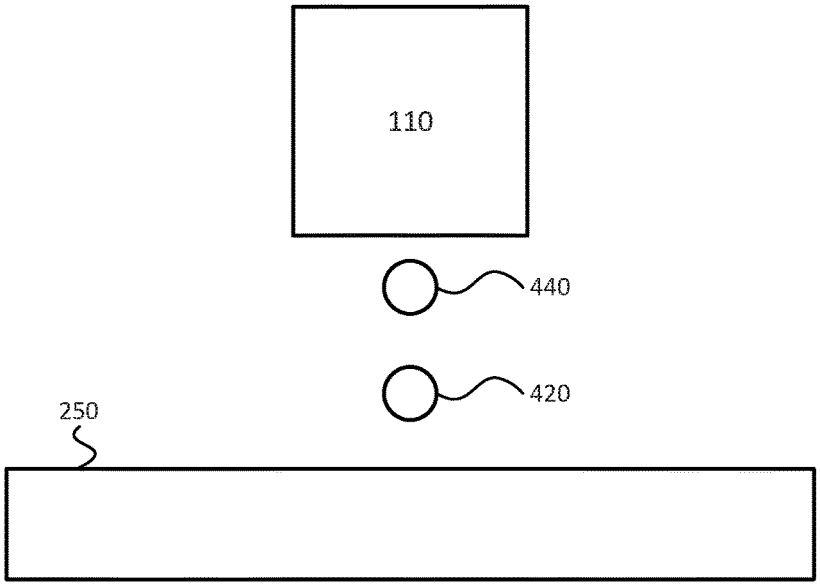
FIG. 4 is a block diagram illustrating an example of a front view of a printing apparatus to determine spit energy levels.

FIG. 4 is a block diagram illustrating an example of a front view of a printing apparatus to determine spit energy levels. The printing apparatus comprises the printhead 110 to spit an amount of a printing fluid in the form of drops onto a printing medium 250. In the illustration example, the printhead 110 has propelled a first drop 420 and a second drop 440 from a printing fluid spit. The printhead 110 is controlled by the controller 120 (not shown for simplicity).

As mentioned above the controller 130 is to determine a decap risk zone. In an example, the controller 120 may control the printhead 110 to spit the printing fluid in a second mode on the decap risk zone and to spit the printing fluid in a first mode onto the areas of the print job other than the decap risk zone.

In another example, the controller 120 may control the printhead 110 to eject the first drop 420 of the spit of printing fluid corresponding to a decap risk zone in the second mode. The controller 120 may control the printhead 110 to eject the second drop 440 and subsequent drops of the spit of printing fluid corresponding to the decap risk zone in the first mode.

The printhead 120 comprises an array of nozzles to propel printing fluid therethrough. Some examples of the printhead 120 may comprise an array of nozzles to spit a plurality of printing fluids. In an example, the controller 120 is further to control the printhead 110 so that the nozzles associated with the decap risk zone, spit the corresponding printing fluid in the second mode leaving the other nozzles with the first mode configuration.

Figure 5:
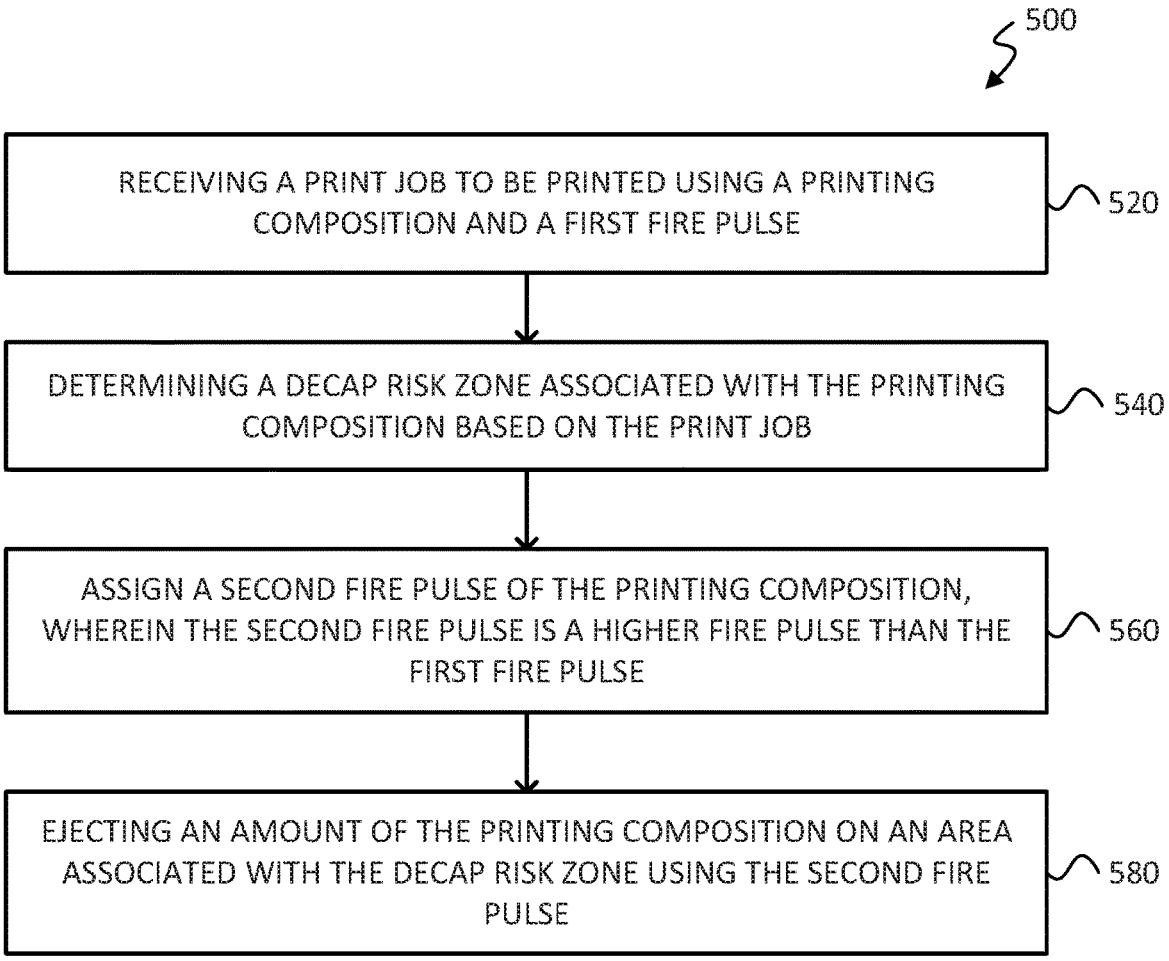
FIG. 5 is a flowchart of an example method for determining spit energy levels.

FIG. 5 is a flowchart of an example method 500 for determining spit energy levels. Method 500 may be described below as being executed or performed by a controller, such as the controller 120 of FIG. 1. Method 500 may be implemented in the form of executable instructions stored on a machine-readable storage medium and executed by a single processor or a plurality of processors, and/or in the form of any electronic circuitry, for example digital and/or analog ASIC. In some implementations of the present disclosure, method 500 may include more or less blocks than are shown in FIG. 5. In some implementations, some of the blocks of method 500 may, at certain times, be performed in parallel and/or may repeat.

Method 500 may be performed by a controller from a printing apparatus. At block 520, the controller may receive a print job to be printed using a printing composition, e.g. printing fluid, and a first fire pulse, e.g. first mode. At block 540, the controller may determine a decap risk zone associated with the printing composition based on the print job. At block 560, the controller 120 may assign a second fire pulse, e.g. second mode, of the printing composition. The second fire pulse is a higher fire pulse than the first fire pulse. At block 580, the controller may control the printhead to eject an amount of the printing composition on an area associated with the decap risk zone using the second fire pulse. The printhead, the carriage, and the controller of method 500 may be the same as or similar to the printhead 110, the carriage 110, and the controller 120 of FIG. 1.

In an example, the controller from method 500 may determine the decap risk zone before the ejection of printing composition, associated to the print job, starts by the printhead.

Figure 6:
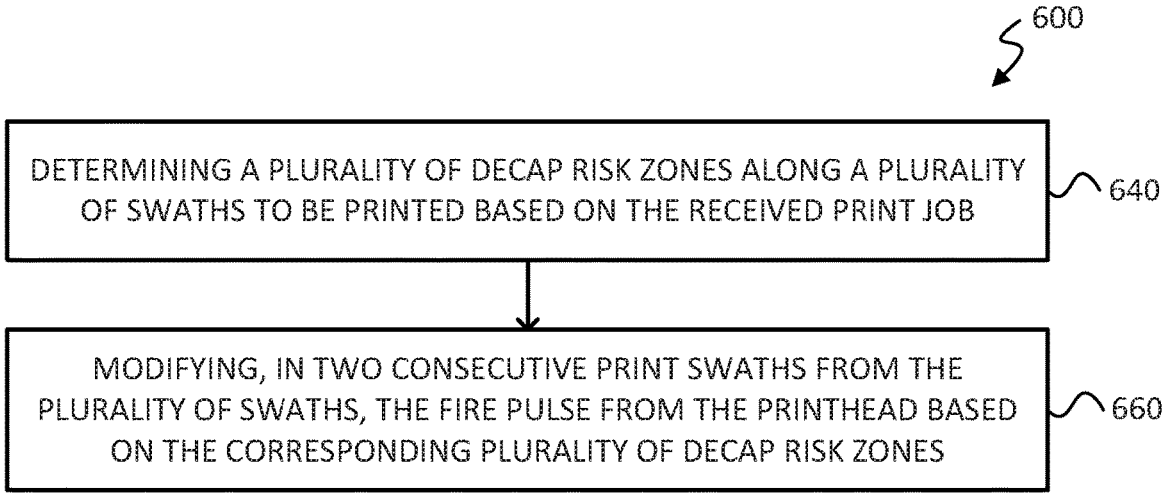
FIG. 6 is a flowchart of an example of another method for determining spit energy levels.

FIG. 6 is a flowchart of an example of another method 600 for determining spit energy levels. Method 600 may comprise method 500 with additional blocks to be performed. Method 600 may be performed by the same entities as method 500 from FIG. 5. In an example, method 600 may be performed by replacing blocks 540 and 560 from FIG. 5 to blocks 640 and 660 respectively. At block 640, the controller may determine a plurality of decap risk zones along a plurality of swaths to be printed based on the received print job. At block 660, the controller may modify, in two consecutive print swaths from the plurality of swaths, the fire pulse from the printhead based on the corresponding plurality of decap risk zones.

Figure 7:
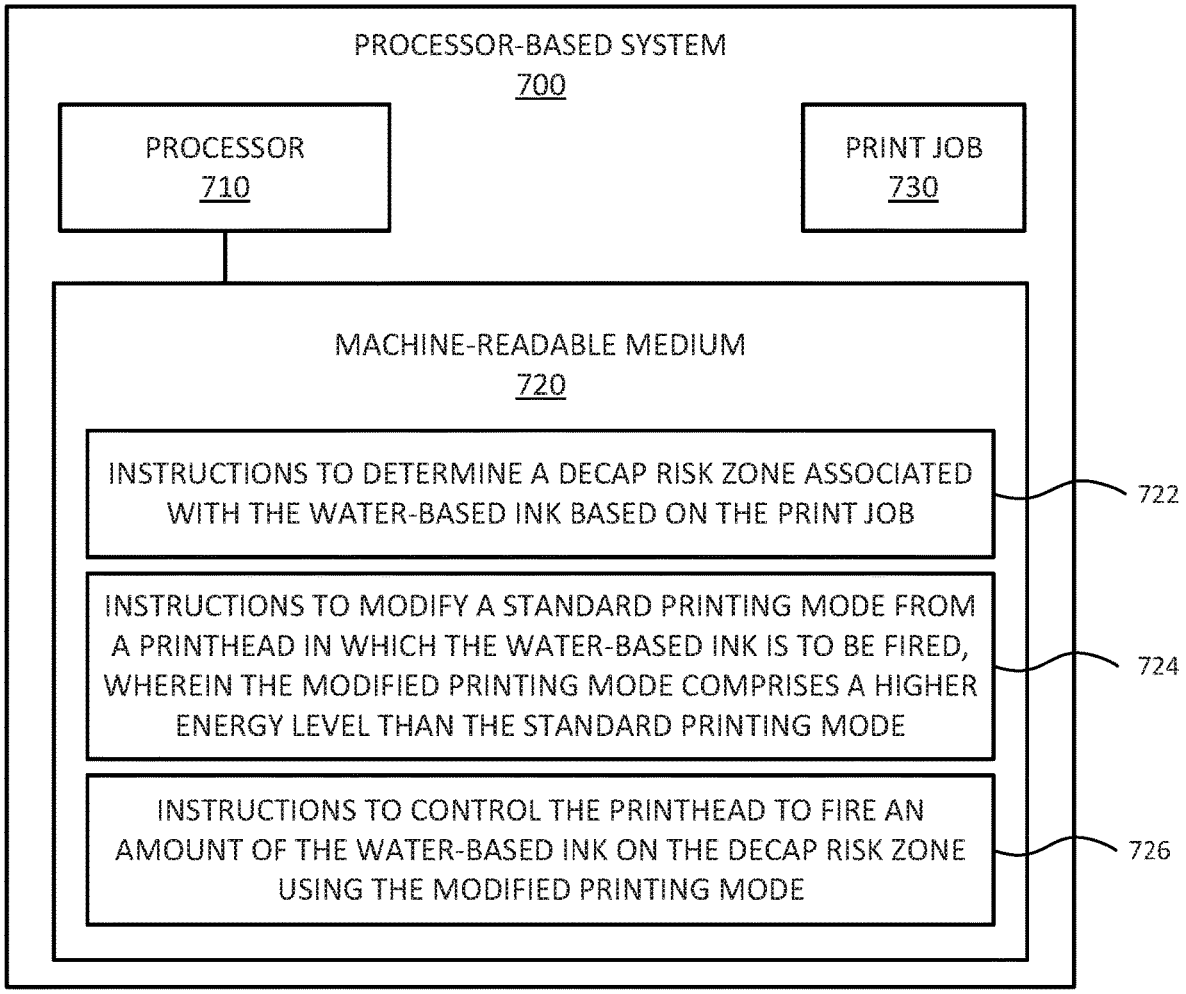
FIG. 7 is a block diagram illustrating an example of a processor-based system to determine spit energy levels.

FIG. 7 is a block diagram illustrating an example of a processor-based system 700 to determine spit energy levels. In some implementations, the system 700 may be or may form part of a printing device, such as a printer. In some implementations, the system 700 is a processor-based system and may include a processor 710 coupled to a machine-readable medium 720. The processor 710 may include a single-core processor, a multi-core processor, an application-specific integrated circuit (ASIC), a field programmable gate array (FPGA), and/or any other hardware device suitable for retrieval and/or execution of instructions from the machine-readable medium 720 (e.g., instructions 722, 724, and 726) to perform functions related to various examples. Additionally, or alternatively, the processor 710 may include electronic circuitry for performing the functionality described herein, including the functionality of instructions 722, 724, and/or 726. With respect of the executable instructions represented as boxes in FIG. 7, it should be understood that part or all of the executable instructions and/or electronic circuits included within one box may, in alternative implementations, be included in a different box shown in the figures or in a different box not shown.

The machine-readable medium 720 may be any medium suitable for storing executable instructions, such as a random-access memory (RAM), electrically erasable programmable read-only memory (EEPROM), flash memory, hard disk drives, optical disks, and the like. In some example implementations, the machine-readable medium 720 may be a tangible, non-transitory medium, where the term "non-transitory" does not encompass transitory propagating signals. The machine-readable medium 720 may be disposed within the processor-based system 700, as shown in FIG. 7, in which case the executable instructions may be deemed "installed" on the system 700. Alternatively, the machine-readable medium 720 may be a portable (e.g., external) storage medium, for example, that allows system 700 to remotely execute the instructions or download the instructions from the storage medium. In this case, the executable instructions may be part of an "installation package". As described further herein below, the machine-readable medium may be encoded with a set of executable instructions 722-726.

The machine-readable medium 720 is to receive a print job 730 to be printed using a water-based ink, i.e. printing fluid. Instructions 722, when executed by the processor 710, may cause the processor 710 to determine a decap risk zone associated with the water-based ink based on the print job 730. Instructions 724, when executed by the processor 710, may cause the processor 710 to modify a standard printing mode, e.g. first mode, from a printhead in which the water-based ink is to be fired. The modified printing mode, e.g. second mode, comprises a higher energy level than the standard printing mode. Instructions 726 when executed by the processor 710, may cause the processor 710 to control the printhead to fire an amount of the water-based ink on the decap risk zone using the modified printing mode.

The above examples may be implemented by hardware, or software in combination with hardware. For example, the various methods, processes and functional modules described herein may be implemented by a physical processor (the term processor is to be implemented broadly to include CPU, SoC, processing module, ASIC, logic module, or programmable gate array, etc.). The processes, methods and functional modules may all be performed by a single processor or split between several processors; reference in this disclosure or the claims to a "processor" should thus be interpreted to mean "at least one processor". The processes, method and functional modules are implemented as machine-readable instructions executable by at least one processor, hardware logic circuitry of the at least one processors, or a combination thereof.

As used herein, the terms "about" and "substantially" may be used to provide flexibility to a numerical range endpoint by providing that a given value may be, for example, an additional 20% more or an additional 20% less than the endpoints of the range. The degree of flexibility of this term can be dictated by the particular variable and would be within the knowledge of those skilled in the art to determine based on experience and the associated description herein. In some examples herein, the terms "about" and "substantially" may be used to provide flexibility to a relative position and/or an absolute position.

The drawings in the examples of the present disclosure are some examples. It should be noted that some units and functions of the procedure may be combined into one unit or further divided into multiple sub-units. What has been described and illustrated herein is an example of the disclosure along with some of its variations. The terms, descriptions and figures used herein are set forth by way of illustration. Many variations are possible within the scope of the disclosure, which is intended to be defined by the following claims and their equivalents.

Example implementations can be realized according to the following clauses:

Clause 1: A printing apparatus comprising (i) printhead to spit a printing fluid comprising a first mode and a second mode, wherein the first mode corresponds to using a first energy level to spit the printing fluid and a second mode corresponding to using a second energy level to spit the printing fluid, wherein the second energy level comprises a higher energy level than the first energy level; and (ii) a controller to (a) determine a decap risk zone associated with the printing fluid; (b) determine in view of the decap risk zone a decap location; and (c) instruct the printhead to spit using the second mode at the decap location.

Clause 2: The printing apparatus of clause 1, wherein controller is to determine the decap risk zone, the controller to: (i) receive a print job to be printed; (ii) determine an idle time of the printing fluid based on the print job, wherein the idle time is a time between two consecutive spits of the printing fluid; and (iii) determine the decap risk zone associated with the printing fluid based on at least one of the idle time and a printing fluid composition.

Clause 3: The printing apparatus of any preceding clause, wherein the printhead is mounted in a carriage that moves over a print zone along a swath, wherein the swath is the movement from a first end of the print zone to a second end of the print zone.

Clause 4: The printing apparatus of any preceding clause, wherein the controller is to control the printhead to shift between the first mode and the second mode between two consecutive swaths of the print job.

Clause 5: The printing apparatus of any preceding clause, wherein the controller is to control the printhead to: (i) eject a first drop of the spit of the printing fluid in the second mode; and (ii) eject a second drop of the spit of the printing fluid in the first mode, wherein the first drop is to be ejected before the second drop.

Clause 6: The printing apparatus of any preceding clause, wherein the printing fluid is to be spit on a media, the controller is further to select the second energy mode by checking a look up table.

Clause 7: The printing apparatus of any preceding clause, wherein the printhead comprises an array of nozzles to spit a plurality of printing fluids, the controller is further to control the nozzles associated with the decap risk zone to spit the printing fluid in the second mode.

Clause 8: The printing apparatus of any preceding clause, wherein the first mode comprises a fire pulse frequency that comprises a value from a range defined by 550 nanoseconds (ns) and 650 ns.

Clause 9: The printing apparatus of any preceding clause, wherein the second mode comprises a fire pulse frequency that comprises a value from a range defined by 650 ns and 750 ns.

Clause 10: The printing apparatus of any preceding clause, wherein the printer is a large-format printer, and wherein the printhead spit the printing fluid in a plurality of passes, the controller further to: (i) control the printhead to spit the printing fluid in the second mode during a first group of passes from the plurality of passes; and (ii) control the printhead to spit the printing fluid in the first mode during a second group of passes from the plurality of passes, wherein the second group comprises different passes than the first group.

Clause 11: A method comprising (i) receiving a print job to be printed using a printing composition and a first fire pulse; (ii) determining a decap risk zone associated with the printing composition based on the print job; (iii) assign a second fire pulse of the printing composition, wherein the second fire pulse is a higher fire pulse than the first file pulse; and (iv) ejecting an amount of the printing composition on an area associated with the decap risk zone using the second fire pulse.

Clause 12: The method of clause 11, further comprising determining a plurality of decap risk zones along a plurality of swaths to be printed based on the received print job.

Clause 13: The method of any of the clauses 11 to 12, further comprising modifying, in two consecutive print swaths from the plurality of print swaths, the fire pulse from the printhead based on the corresponding plurality of decap risk zones.

Clause 14: The method of any of the clauses 11 to 13, further comprising determining the decap risk zone before the ejection of printing composition associated to the print job starts by the printhead.

Clause 15: A non-transitory machine-readable medium storing instructions executable by a processor, the medium to receive a print job to be printed using a water-based ink, the non-transitory machine-readable medium comprising: (i) instructions to determine a decap risk zone associated with the water-based ink based on the print job; (ii) instructions to modify a standard printing mode from a printhead in which the water-based ink is to be fired, wherein the modified printing mode comprises a higher energy level than the standard printing mode; and (iii) instructions to control the printhead to fire an amount of the water-based ink on the decap risk zone using the modified printing mode.

What it is claimed is:

1. A printing apparatus comprising:

a printhead to spit a printing fluid comprising a first mode and a second mode, wherein the first mode corresponds to using a first energy level to spit the printing fluid and a second mode corresponding to using a second energy level to spit the printing fluid, wherein the second energy level comprises a higher energy level than the first energy level; and a controller to:

determine a decap risk zone associated with the printing fluid, determine in view of the decap risk zone a decap location, and instruct the printhead to spit using the second mode at the decap location.

2. The printing apparatus of claim 1, wherein the controller is to determine the decap risk zone, the controller to:

receive a print job to be printed;

determine an idle time of the printing fluid based on the print job, wherein the idle time is a time between two consecutive spits of the printing fluid; and determine the decap risk zone associated with the printing fluid based on at least one of the idle time and a printing fluid composition.

3. The printing apparatus of claim 1, wherein the printhead is mounted in a carriage that moves over a print zone along a swath, wherein the swath is the movement from a first end of the print zone to a second end of the print zone.

4. The printing apparatus of claim 3, wherein the controller is to control the printhead to shift between the first mode and the second mode between two consecutive swaths of the print job.

5. The printing apparatus of claim 1, wherein the controller is to control the printhead to:

eject a first drop of the spit of the printing fluid in the second mode; and eject a second drop of the spit of the printing fluid in the first mode, wherein the first drop is to be ejected before the second drop.

6. The printing apparatus of claim 1, wherein the printing fluid is to be spit on a media, the controller is further to select the second energy mode by checking a look up table.

7. The printing apparatus of claim 1, wherein the printhead comprises an array of nozzles to spit a plurality of printing fluids, the controller is further to control the nozzles associated with the decap risk zone to spit the printing fluid in the second mode.

8. The printing apparatus of claim 1, wherein the first mode comprises a fire pulse frequency that comprises a value from a range defined by 550 nanoseconds (ns) and 650 ns.

9. The printing apparatus of claim 1, wherein the second mode comprises a fire pulse frequency that comprises a value from a range defined by 650 ns and 750 ns.

10. The printing apparatus of claim 1, wherein the printer is a large-format printer, and wherein the printhead spit the printing fluid in a plurality of passes, the controller further to:

control the printhead to spit the printing fluid in the second mode during a first group of passes from the plurality of passes; and control the printhead to spit the printing fluid in the first mode during a second group of passes from the plurality of passes, wherein the second group comprises different passes than the first group.

11. The printing apparatus of claim 1, wherein the first mode and the second mode each comprise a pulse-width modulated signal, the second mode have a higher voltage, current or frequency firing signal than the first mode.

12. The printing apparatus of claim 1, wherein the controller is to determine the decap risk zone based on both a composition of the printing fluid and an idle time between two consecutive spits of the printing fluid.

13. The printing apparatus of claim 1, wherein the controller is to only shift from the first mode to the second mode nozzles of the printhead corresponding to a determined decap risk.

14. The printing apparatus of claim 1, wherein both the first and second modes are used within a single swath of the printhead based on the decap risk zone.

15. A method comprising:

receiving a print job to be printed using a printing composition and a first fire pulse;

determining a decap risk zone associated with the printing composition based on the print job;

assign a second fire pulse of the printing composition, wherein the second fire pulse is a higher fire pulse than the first file pulse; and ejecting an amount of the printing composition on an area associated with the decap risk zone using the second fire pulse.

16. The method of claim 15, further comprising determining a plurality of decap risk zones along a plurality of swaths to be printed based on the received print job.

17. The method of claim 16, further comprising modifying, in two consecutive print swaths from the plurality of print swaths, the fire pulse from the printhead based on the corresponding plurality of decap risk zones.

18. The method of claim 15, further comprising determining the decap risk zone before the ejection of printing composition associated to the print job starts by the printhead.

19. The method of claim 15, wherein determining the decap risk zone based on the print job is performed by a printing apparatus when the printing apparatus is currently printing another print job.

20. A non-transitory machine readable medium storing instructions executable by a processor, the medium to receive a print job to be printed using a water-based ink, the non-transitory machine-readable medium comprising:

instructions to determine a decap risk zone associated with the water-based ink based on the print job;

instructions to modify a standard printing mode from a printhead in which the water-based ink is to be fired, wherein the modified printing mode comprises a higher energy level than the standard printing mode; and instructions to control the printhead to fire an amount of the water-based ink on the decap risk zone using the modified printing mode.

* * * * *